US011085216B2

(12) United States Patent
Reich

(10) Patent No.: US 11,085,216 B2
(45) Date of Patent: Aug. 10, 2021

(54) DISPLACEMENT ARRANGEMENT HAVING A ROLLING BEARING GUIDE

(71) Applicant: Roto Frank Fenster—und Tuertechnologie GmbH, Leinfelden-Echterdingen (DE)

(72) Inventor: Winfried Reich, Berglen (DE)

(73) Assignee: Roto Frank Fenster- und Tuertechnologie GmbH, Leinfelden-Echterdingen (DE)

( * ) Notice: Subject to any disclaimer, the term of this patent is extended or adjusted under 35 U.S.C. 154(b) by 197 days.

(21) Appl. No.: 16/465,325

(22) PCT Filed: Dec. 6, 2017

(86) PCT No.: PCT/EP2017/081694
§ 371 (c)(1),
(2) Date: May 30, 2019

(87) PCT Pub. No.: WO2018/114337
PCT Pub. Date: Jun. 28, 2018

(65) Prior Publication Data

US 2019/0345749 A1 Nov. 14, 2019

(30) Foreign Application Priority Data

Dec. 19, 2016 (DE) ..... 10 2016 225 385.9

(51) Int. Cl.
*E05D 15/10* (2006.01)

(52) U.S. Cl.
CPC ..... *E05D 15/10* (2013.01); *E05D 2015/1039* (2013.01); *E05Y 2201/684* (2013.01);
(Continued)

(58) Field of Classification Search
CPC ..... E05D 15/10; E05D 2015/1028; E05D 2015/1039
See application file for complete search history.

(56) References Cited

U.S. PATENT DOCUMENTS 3,660,936 A * 5/1972 Bryson ..... E05D 15/10 49/209
4,341,043 A * 7/1982 Yamamoto ..... E06B 7/18 49/209

(Continued)

FOREIGN PATENT DOCUMENTS

CA 2680754 A1 * 9/2008 ..... E06B 3/4627
CN 102639802 A 8/2012

(Continued)

OTHER PUBLICATIONS

International Preliminary Report on Patentability dated Mar. 14, 2019 for PCT/EP2017/081694 filed on Dec. 6, 2017 (English translation).

(Continued)

*Primary Examiner* — Marcus Menezes
(74) *Attorney, Agent, or Firm* — Collard & Roe, P.C.

(57) ABSTRACT

A displacement arrangement for moving a window sash or a door leaf has a control part which is displaced by an actuating device relative to a guide part which can be mounted fixedly on the sash/leaf. A first control projection is provided between the control part and actuating device and engages in a first control slot of the control part and engages in a first guide slot of the guide part. The first control projection has a first rolling bearing for bearing on the first guide slot. The first control projection can have a second rolling bearing for supporting on the first control slot. A supporting rolling bearing can be provided between the guide part and the control part. The displacement arrangement allows the generation of a high contact pressure of the sash/leaf on the fixed frame under moderate operating forces and thus good sealing of the window or the door.

10 Claims, 5 Drawing Sheets

(52) U.S. Cl.
CPC ... *E05Y 2201/688* (2013.01); *E05Y 2900/132* (2013.01); *E05Y 2900/148* (2013.01)

(56) References Cited

U.S. PATENT DOCUMENTS

| | | | | |
|---|---|---|---|---|
| 4,538,323 | A * | 9/1985 | Johnson | E05D 15/063 16/102 |
| 4,688,352 | A * | 8/1987 | Kinoshita | E05D 15/10 49/209 |
| 5,012,611 | A * | 5/1991 | Hsu | E06B 7/18 49/225 |
| 10,077,594 | B2 * | 9/2018 | Fingerle | E05B 17/0025 |
| 2009/0038228 | A1 * | 2/2009 | Lee | E06B 3/4627 49/360 |
| 2015/0052819 | A1 * | 2/2015 | Lee | E05D 15/0665 49/420 |
| 2016/0145932 | A1 * | 5/2016 | Fingerle | E05C 9/063 49/413 |
| 2019/0292828 | A1 * | 9/2019 | Liu | E05C 9/063 |
| 2019/0345749 | A1 * | 11/2019 | Reich | E05D 15/10 |

FOREIGN PATENT DOCUMENTS

| | | | | |
|---|---|---|---|---|
| CN | 105492713 | A | 4/2016 | |
| CN | 105804592 | A | 7/2016 | |
| CN | 105909155 | A | 8/2016 | |
| CN | 205669368 | U | 11/2016 | |
| CN | 205805165 | U | 12/2016 | |
| DE | 2136079 | A1 * | 2/1973 | E06B 7/18 |
| DE | 19615405 | A1 * | 10/1997 | E05D 15/10 |
| DE | 102014220837 | B3 | 1/2016 | |
| DE | 102016225385 | A1 * | 6/2018 | E05D 15/10 |
| EP | 2829679 | A1 | 1/2015 | |
| WO | 2007139354 | A1 | 12/2007 | |
| WO | WO-2007139354 | A1 * | 12/2007 | E06B 3/4627 |
| WO | 2012093382 | A1 | 7/2012 | |
| WO | 2015010925 | A1 | 1/2015 | |
| WO | WO-2015082325 | A1 * | 6/2015 | E05D 15/10 |
| WO | 2016058756 | A1 | 4/2016 | |
| WO | 2017206273 | A1 | 12/2017 | |
| WO | WO-2020007830 | A1 * | 1/2020 | E05D 15/10 |

OTHER PUBLICATIONS

Chinese Office Action dated Nov. 24, 2020 issued in the corresponding Chinese Application No. 201780078196.8 with English translation of relevant parts.

English translation of the German Office Action dated Sep. 25, 2017.

International Search Report of PCT/EP2017/081694, dated Feb. 6, 2018.

German Office Action dated Sep. 25, 2017 (English translation of the relevant parts will be provided at a later late).

Chinese Office Action dated Apr. 23, 2020 issued in the corresponding Chinese Application No. 201780078196.8 with English translation of relevant parts.

* cited by examiner

DISPLACEMENT ARRANGEMENT HAVING A ROLLING BEARING GUIDE

CROSS REFERENCE TO RELATED APPLICATIONS

This application is the National Stage of PCT/EP2017/081694 filed on Dec. 6, 2017, which claims priority under 35 U.S.C. § 119 of German Application No. 10 2016 225 385.9 filed on Dec. 19, 2016, the disclosures of which are incorporated by reference. The international application under PCT article 21(2) was not published in English.

BACKGROUND OF THE INVENTION

The invention relates to a displacement arrangement for the displacement of a window sash or a door leaf transversely to the primary plane of a fixed frame of the window or the door according to the preamble of the claim 1. Furthermore, the invention relates to a window or a door with such a displacement arrangement.

From the EP 2 829 679 A1 a displacement arrangement mentioned at the beginning has become known, which has a guide part that can be arranged fixedly on a sash/leaf and a first control part guided on the guide part. The first control part has a curved extending first control slot, in which a first control projection is guided, wherein the first control projection is fixedly connected to an actuating mechanism in the shape of a drive rod.

The WO 2007/139354 A1 discloses an actuating mechanism in the shape of a drive rod on which a roller arrangement is mounted, wherein the drive rod is incorporated into a guide profile having a U-shaped cross-section. The guide profile has curved extending control slots in which control projections are guided, wherein the control projections are fixedly mounted on drive rods. The control projections may have rolling bearings to reduce the friction between the control projections and the control slots.

Furthermore, from the WO 2012/093382 A1, a displacement arrangement has become known, which has a control projection, wherein the control projection is guided in a control slot. To reduce the friction between the control projection and the control slot, a rolling bearing is arranged on the control projection.

The DE 10 2014 220 837 B3 discloses a displacement arrangement having a roller arrangement. The roller arrangement comprises a guide part which can be arranged on a sash/leaf and a first control part having a roller which can be displaced relative to the guide part. A plurality of rolling bearings are provided between the first control part and the guide part.

It is therefore known that the arrangement of a rolling bearing between the control projection and the control slot reduces the friction during the actuation of the displacement arrangement. Nevertheless, it has been shown that very heavy sashes/leafs having multiple glazing are particularly difficult to be set-out from the fixed frame in a positively controlled manner. Furthermore, the known solutions allow only a limited contact pressure to be generated by user-friendly operating forces.

SUMMARY OF THE INVENTION

Thus, the object of the present invention is to provide a displacement arrangement that allows an easier sash/leaf movement by a user. Furthermore, the object of the present invention is to provide a window or a door with such a displacement arrangement.

This object is solved by a displacement arrangement according to claim 1 or a window or door according to claim 10. The subclaims represent preferred embodiments.

The object according to the invention is therefore solved by a displacement arrangement for a window sash or a door leaf, wherein the sash/leaf is set-out from the fixed frame in a positively controlled manner by actuating an actuating mechanism of the displacement arrangement. The displacement arrangement has a first control projection and a first control slot, wherein the first control projection engages the first control slot. The first control slot extends at least in portions obliquely to the primary plane of the sash/leaf, wherein the primary plane of the sash/leaf corresponds in particular to the plane spanned by the actuating mechanism. A displacement of the first control projection by means of the actuating mechanism causes a movement of a control part of the displacement arrangement so that the setting-out of the sash/leaf from the fixed frame can occur. The displacement arrangement also has a guide part that can be arranged fixedly on the sash/leaf. The first control projection is partly guided in a first guide slot, which is formed in the guide part. The first guide slot preferably extends in the primary plane of the sash/leaf or parallel to the primary plane of the sash/leaf. The first control projection has a first rolling bearing in the area of the first guide slot, which can be supported by the first guide slot when the actuating mechanism is actuated. The control part is preferably relocatable transversely to the primary plane of the sash/leaf.

The invention is based on the knowledge that the operation of the actuating mechanism is considerably facilitated if the sliding friction of the first control projection on the guide part is eliminated. This sliding friction has so far been neglected, since it was assumed that significant friction losses only occur between the first control projection and the first control slot. However, it has been shown that, particularly in the case of high contact forces of the sash/leaf against the fixed frame (and the resulting compression of a seal between the sash/leaf and the fixed frame), the friction between the first control projection and the first guide slot constitutes a large part of the resistance of the actuating mechanism for a user. Thus, the arrangement of the first rolling bearing between the first control projection and the first guide slot significantly facilitates the operation of the displacement arrangement.

The first rolling bearing can be in the shape of a ball bearing or a needle bearing. The first rolling bearing can have a metal outer ring. Alternatively or in addition, the first rolling bearing can have an additional body, particularly in the shape of an additional outer ring, made of plastic. In this case, the outer ring of the first rolling bearing can be encapsulated with plastic. The first rolling bearing preferably has a clearance of less than 2 mm in the first guide slot, in particular less than 1 mm, preferably less than 0.5 mm, further preferably less than 0.2 mm, more preferably less than 0.1 mm.

In the preferred embodiment of the displacement arrangement, the first control projection is arranged or formed on the actuating mechanism and the first control slot is arranged or formed on the first control part. As a result, a particularly simple construction of the displacement arrangement is made possible.

The first control part can be guided on the guide part in such a way that it can only be moved in one direction relative to the guide part. Preferably, the control part can only be moved vertically to the primary plane of the sash/leaf relative to the guide part.

The first control part can be pivoted on the guide part. Preferably the rotational axis is arranged parallel to the primary plane of the sash/leaf or in the primary plane of the sash/leaf.

The displacement arrangement can have a roller arrangement connected to the control part on the lower side of the displacement arrangement and/or a support arrangement on the upper side of the displacement arrangement. The support arrangement can have a roller with a rotational axis, wherein the rotational axis is aligned in particular in the primary plane of the sash/leaf.

In addition to the first rolling bearing, the first control projection can have a second rolling bearing in the area of the first control slot to minimize the friction losses between the first control projection and the first control slot. The second rolling bearing can be in the shape of a ball bearing or a needle bearing. Preferably, the first rolling bearing and the second rolling bearing are of the same shape.

Further preferred, the displacement arrangement has a supporting rolling bearing which is arranged or formed between the guide part and the control part. The supporting rolling bearing can be in the form of a ball bearing or—preferably—in the form of a rolling bearing with a plurality of needle rollers.

The displacement arrangement can have a second control projection which engages in a second control slot and is guided in a second guide slot of the guide part. The second control slot is at least in portions obliquely formed in relation to the primary plane of the sash/leaf. The second guide slot preferably extends in the primary plane of the sash/leaf or parallel to the primary plane of the sash/leaf.

The first rolling bearing of the second control projection preferably has in the second guide slot a clearance of less than 2 mm, in particular less than 1 mm, preferably less than 0.5 mm, more preferably less than 0.2 mm, in particular preferably less than 0.1 mm.

Preferably, the second control projection has a first rolling bearing for supporting the second control projection on the second guide slot. Alternatively or in addition, the second control projection can have a second rolling bearing for supporting the second control projection on the second control slot.

The first rolling bearing of the first control projection can be the same as the first rolling bearing of the second control projection. The second rolling bearing of the first control projection can be the same as the second rolling bearing of the second control projection. Preferably the first control projection is formed the same way as the second control projection.

Furthermore, the object according to the invention is solved by a window or a door having a fixed frame, a sash/leaf and a displacement arrangement described above. The guide part can be fixedly mounted to the sash/leaf.

The sash/leaf is preferably built in the shape of a slide sash/leaf, which can, in particular parallel, be set-out from the fixed frame and can be displaced parallel to the fixed frame.

Additional features and advantages of the invention result from the following detailed description of a plurality of embodiment examples of the invention, from the claims and from the figures in the drawing showing essential details of the invention. The various features can be executed individually for themselves or in a plurality of random combinations at variants of the invention. The features shown in the drawing are presented in such a way that the special features of the invention can be made clearly evident.

BRIEF DESCRIPTION OF THE DRAWING FIGURES

DETAILED DESCRIPTION OF THE INVENTION

Figure 1:
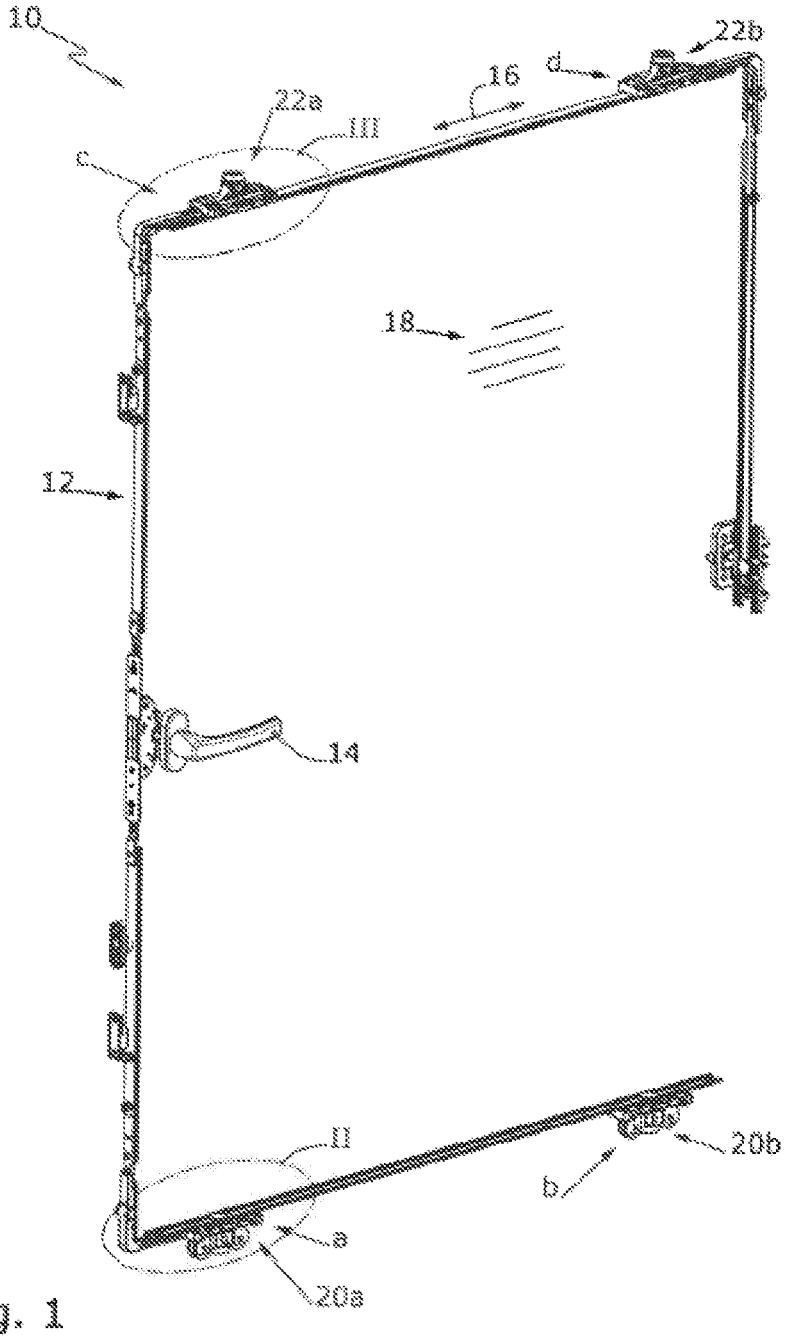
FIG. 1 is an isometric representation of a displacement arrangement.

FIG. 1 shows a displacement arrangement 10 having an actuating mechanism 12 in the shape of a circumferential drive rod fitting, which can be operated via an actuating handle 14. The actuating mechanism 12 is mounted on a window or a door shown in FIGS. 4 and 5 and extends along the fold circumferential direction 16. The fold circumferential direction 16 extends in the primary plane 18 (only indicated in FIG. 1) of the window or the door. In the embodiment shown, the displacement arrangement 10 has two positions a, b having a roller arrangement 20*a*, 20*b* and two positions c, d having a support arrangement 22*a*, 22*b*, wherein the roller arrangements 20*a*, 20*b* and the support arrangements 22*a*, 22*b* are each displaceable transversely to the fold circumferential direction 16.

Figure 2:
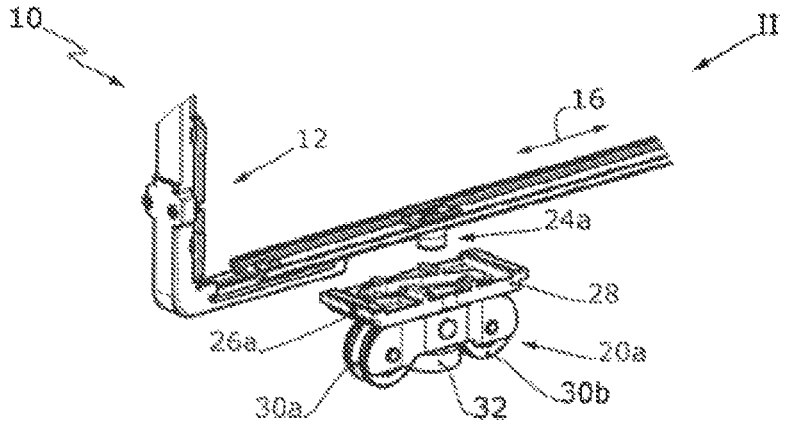
FIG. 2 is a partial exploded view of the Detail II from FIG. 1.

FIG. 2 shows a part of the components of the Section II according to FIG. 1. It is recognizable that the actuating mechanism 12 has a pin-shaped first control projection 24*a* which engages a first control slot 26*a* which is formed in the shape of a first control slot. The first control slot 26*a* is at least partially formed obliquely to the fold circumferential direction 16. If the actuating mechanism 12 is relocated in the fold circumferential direction 16, the roller arrangement 20*a* is relocated vertically to the fold circumferential direction 16. The first control slot 26*a* is formed in a control part 28.

The roller arrangement 20*a* has at least one roller 30*a*, 30*b*. In addition, the roller arrangement 20*a* in this case has a support roller 32. The support roller 32 has an outer diameter which is larger than the width of the remaining roller arrangement 20*a*. This means that transverse forces on the roller arrangement 20*a* can be avoided by supporting the support roller 32.

Figure 3:
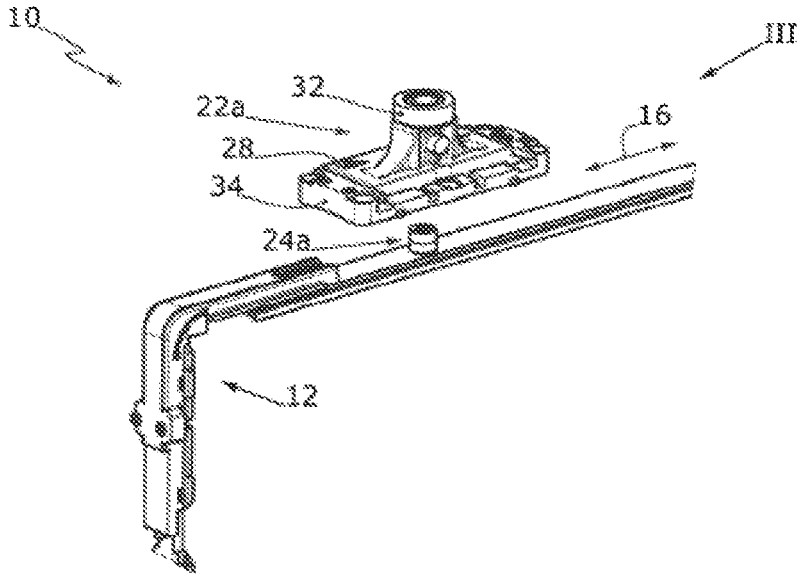
FIG. 3 is a partial exploded view of the Detail III from FIG. 1.

FIG. 3 shows a representation of the Detail III according to FIG. 1. The support arrangement 22*a* also has a support roller 32 which is arranged around a vertical rotational axis. Analogous to the construction according to FIG. 2, the displacement arrangement 10 in the area of the Detail III has a control part 28 with a first control slot (not visible) in which a first control projection 24*a* engages. Furthermore, the displacement arrangement 10 has a guide part 34 which is not shown in the displacement arrangement 10 according to FIG. 2. The guide part 34 is fixedly mounted on the 5 sash/leaf 40 (see FIGS. 4, 5). The first control projection 24*a* is mounted on a not shown first guide slot in the guide part 34 to reduce the friction during the operation of the actuating mechanism 12 in fold circumferential direction 16. The first control projection 24*a* engages through the guide part 34 and engages into the control part 28.

Figure 4:
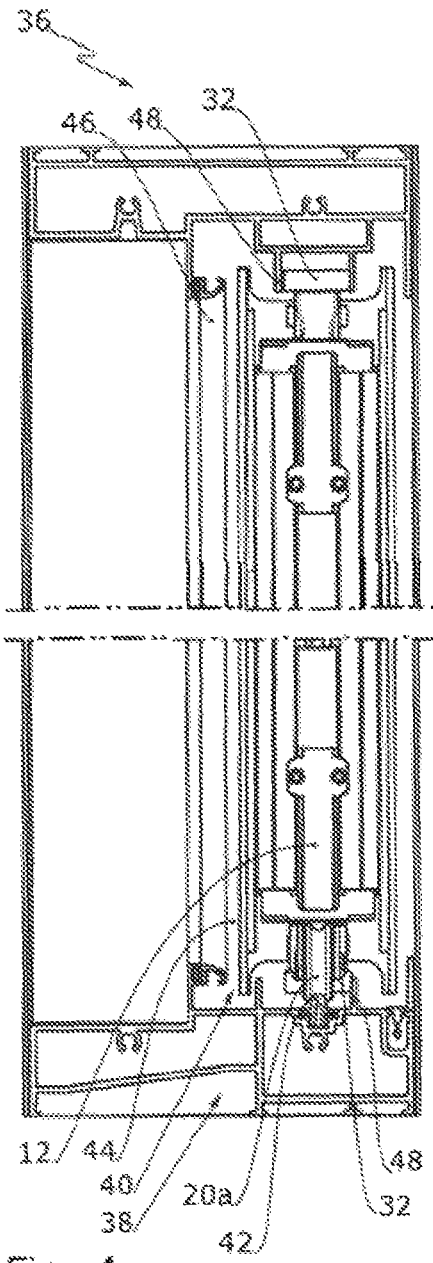
FIG. 4 is a view from the closure side onto a sash/leaf having a closure arrangement, wherein the sash/leaf is arranged spaced apart from a fixed frame.

FIG. 4 shows a view from the closure side of a window or door 36 with a fixed frame 38 and a sash/leaf 40. The actuating mechanism 12 is mounted on the sash/leaf 40. This is supported by the roller arrangement 20*a* on a running rail 42. There is a gap 44 between the sash/leaf 40 and the fixed frame 38. The sash/leaf 40 therefore does not bear against a circumferential seal 46 of the fixed frame 38.

The support roller 32 bears against a guide 48 of the fixed frame 38 formed as a vertical web. In the position shown, the sash/leaf 40 can be displaced relative to the fixed frame 38, wherein the support roller 32 can support itself or roll on the guide 48. In the upper area of the window or the door 36, the fixed frame 38 also has a guide 48, which here is formed groove-like. The support roller 32 (see also FIG. 3) is guided in the guide 48.

Figure 5:
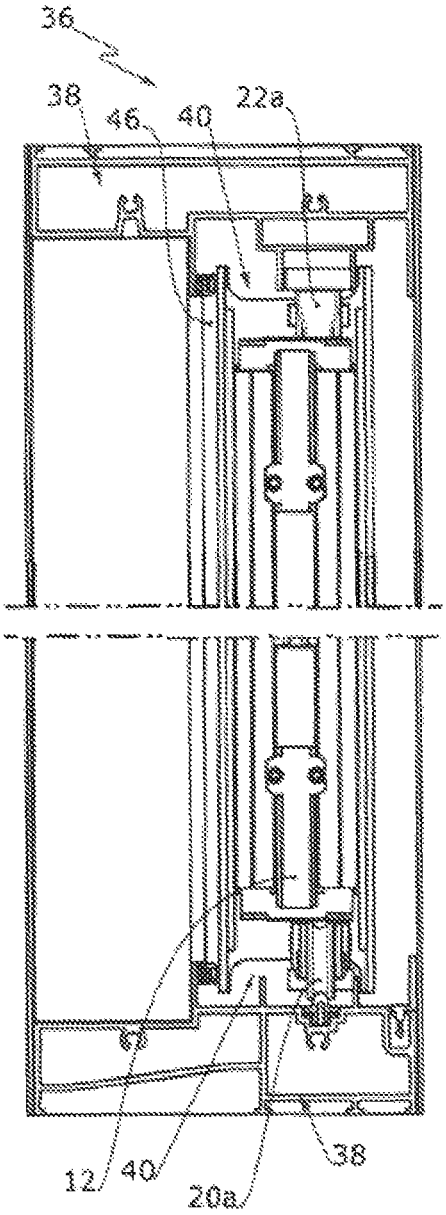
FIG. 5 is a representation corresponding to FIG. 4, wherein the sash/leaf has been relocated in relation to the representation of FIG. 4 transversely to the primary plane of the fixed frame.

FIG. 5 shows the window or the door 36 after operating the actuating mechanism 12. By the actuation of the actuating mechanism 12 the roller arrangements (in FIG. 5 the roller arrangement 20*a* is visible) and the support arrangements (in FIG. 5 the support arrangement 22*a* is visible) are relocated. This means that the sash/leaf 40 approaches the fixed frame 38 so that the seal 46 is clamped and compressed between the sash/leaf 40 and the fixed frame 38.

Figure 6:
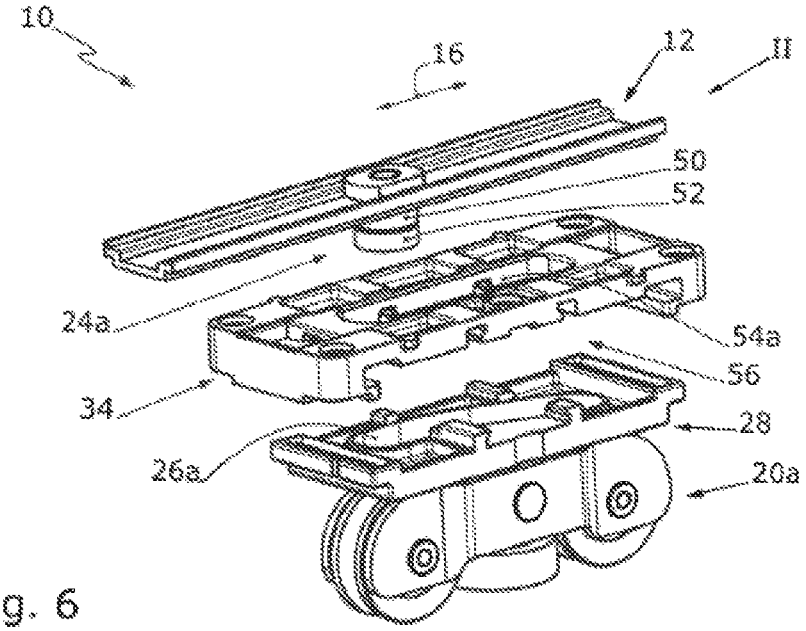
FIG. 6 is an additional partial exploded view of the Detail II of FIG. 1.

FIG. 6 shows an additional detailed view of the displacement arrangement 10 according to Detail II of FIG. 1. FIG. 6 shows that the first control projection 24*a* has a cylindrical shape and is arranged on the actuating mechanism 12. The first control projection 24*a* has a first rolling bearing 50 and a second rolling bearing 52. The first rolling bearing 50 is used for the low-friction guide of the first control projection 24*a* in a first guide slot 54*a* of the guide part 34. The second rolling bearing 52 is used for the low-friction guide of the first control projection 24*a* in the first control slot 26*a* of the control part 28.

The first guide slot 54*a* is formed in the direction of the fold circumferential direction 16 or parallel to the fold circumferential direction 16, whereas the first guide slot 26*a* is formed at least partially transverse to the fold circumferential direction 16. The roller arrangement 20*a* is arranged on the control part 28. The displacement arrangement 10 in the area of the Detail III (see FIG. 3) is formed analogously to this, wherein the control part 28 has the support arrangement 22*a* (see FIG. 3) instead of the roller arrangement 20*a*.

The guide part 34 is fixedly, i.e. rigid and stationary, arranged on the sash/leaf 40 (see FIGS. 4, 5), and here it can be screwed on. As can be seen from FIG. 6, a guide 56 is provided between the guide part 34 and the control part 28, which allows only a limited movement of the control part 28 relative to the guide part 34 transverse to the fold circumferential direction 16. In this example, the guide 56 is in the shape of a dovetail guide.

Figure 7:
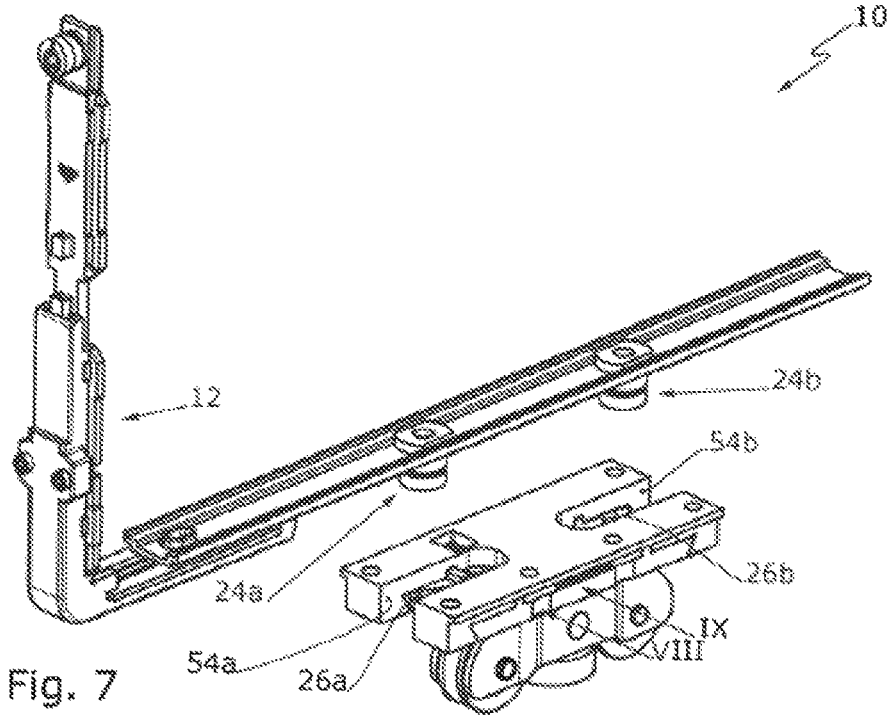
FIG. 7 is an isometric view of an additional embodiment of a displacement arrangement.

FIG. 7 shows an additional example of a displacement arrangement 10. The displacement arrangement 10 has a first control projection 24*a* and a second control projection 24*b*. The control projections 24*a*, 24*b* are formed in the same way. Furthermore, both control projections 24*a*, 24*b* are equal to the first control projection 24*a* according to FIG. 6. Both control projections 24*a*, 24*b* are arranged on the actuating mechanism 12.

The first control projection 24*a* is led in a, here unilaterally open, first guide slot 54*a*. The second control projection 24*b* is led in a second guide slot 54*b*, which is also open here. Furthermore, the first control projection 24*a* engages in a first control slot 26*a* and the second control projection 24*b* engages in a second control slot 26*b*. When the displacement arrangement 10 is actuated, the first control projection 24*a* emerges from the slots 26*a*, 54*a* assigned to it. Shortly before this exit, the second control projection 24*b* enters the assigned slots 26*b*, 54*b*, so that a continuous guide of the control part 28 (see FIGS. 8, 9) is ensured. The embodiment described here is described analogously in DE 10 2014 220 837 B3, to which reference is made in full scope.

Figure 8:
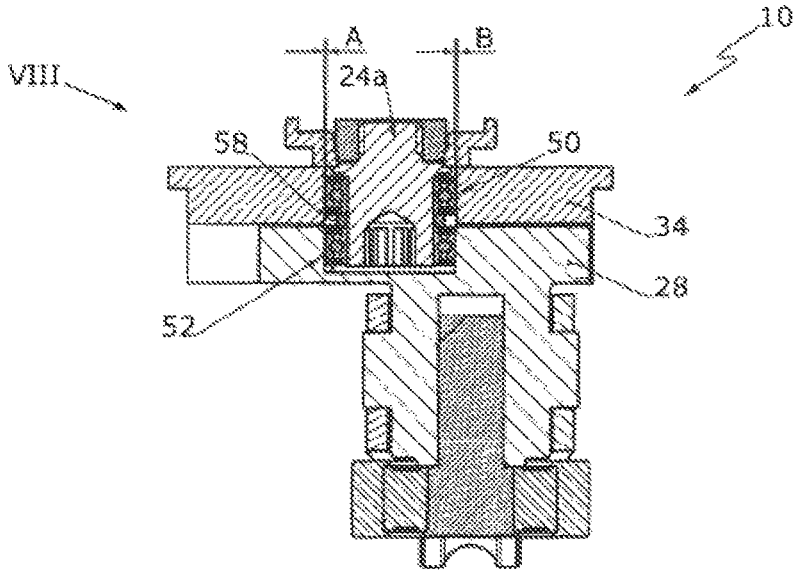
FIG. 8 is a sectional view in the Area VIII according to FIG. 7 with the displacement arrangement mounted.

FIG. 8 shows a cross-section of the displacement arrangement 10 in the Area VIII (see FIG. 7). FIG. 8 shows the guide of the first rolling bearing 50 on the first guide part 34 and the guide of the second rolling bearing 52 on the control part 28. The horizontal clearance of the first control projection 24*a* in the guide part 34 and in the control part 28, which is composed of the distances A and B (indicated enlarged for clarity in FIG. 8), is less than 0.5 mm. Ideally, the clearance tends towards zero. The inner rings of the rolling bearings 50, 52 are spaced apart by a spacer ring 58.

Figure 9:
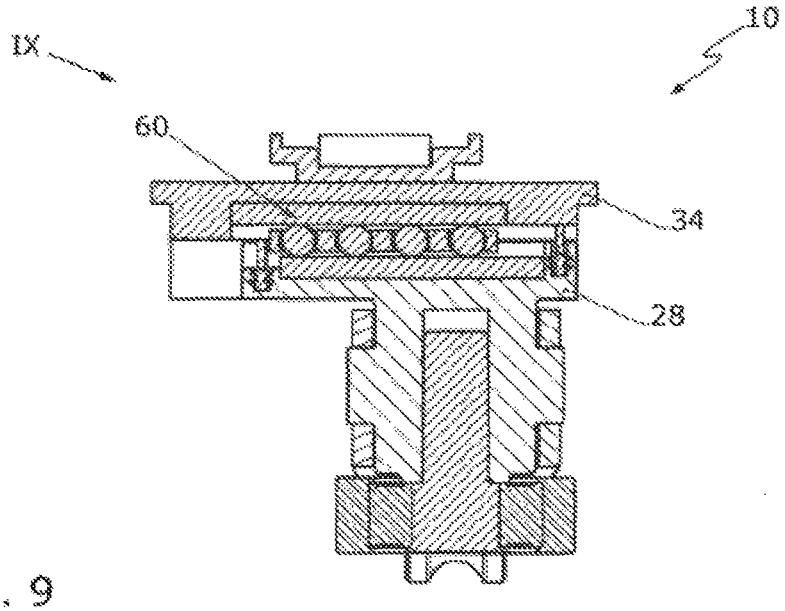
FIG. 9 is a sectional view in the Area IX according to FIG. 7 with the displacement arrangement mounted.

FIG. 9 shows a cross-section of the displacement arrangement 10 in the Area IX (see FIG. 7). FIG. 9 shows that a supporting rolling bearing 60 is arranged between the control part 28 and the guide part 34. This means that even very heavy sashes/leafs 40 (see FIG. 4, 5) can be supported displaceable with low-friction.

Summarizing all the figures in the drawing, the invention relates to a displacement arrangement 10 for moving a sash/leaf 40 of a window or a door 36 transversely to the fixed frame 38 of the window or the door 36. The displacement arrangement 10 has a control part 28 for indirectly supporting the transverse movement, which is displaced relative to a guide part 34 which can be fixedly mounted on the sash/leaf 40 by means of an actuating device 12. A first control projection 24*a* is provided between control part 28 and actuating device 12, which engages in a first control slot 26*a* of the control part 28 and simultaneously in a first guide slot 54*a* of the guide part 34. The first control projection 24*a* has a first rolling bearing 50 for the bearing at the first guide slot 54*a*. In addition, the first control projection 24*a* can have a second rolling bearing 52 for supporting on the first control slot 26*a*. Alternatively or in addition, a supporting rolling bearing 60 can be provided between the guide part 34 and the control part 28. The displacement arrangement 10 makes it possible to generate a high contact pressure of the sash/leaf 40 against the fixed frame 38 with moderate operating forces and thus a good sealing of the window or the door 36. Furthermore, a very low-friction setting-out of even heavy sashes/leafs 40 is possible by means of the operation of the actuating device 12 by a user of the window or the door 36.

What is claimed is:

1. A displacement arrangement for displacement of a sash/leaf of a window or a door transversely to a primary plane of a fixed frame of the window or the door, wherein the displacement arrangement has the following:

a) an actuating mechanism which is configured to be arranged on the sash/leaf and which is movable at least in portions in a peripheral direction;

b) a first control projection;

c) a control part;

d) a first control slot, wherein the first control projection is incorporated in portions in the first control slot and the first control slot is formed at least in portions obliquely to a primary plane of the sash/leaf so that a displacement of the first control projection by the actuating mechanism causes a displacement of the control part;

e) a guide part that is configured to be mounted immovably on the sash/leaf and has a first guide slot guiding portions of the first control projection;

wherein the control part is at least partially movable relative to the guide part to effect the displacement of the sash/leaf relative to the fixed frame;

wherein the first control projection is arranged or formed on the actuating mechanism and the first control slot is arranged or formed on the control part;

wherein the first control projection has a first rolling bearing for low-friction guidance of the first control projection in the first guide slot.

2. The displacement arrangement according to claim 1, wherein the control part is guided on the guide part, wherein the control part is guided transversely to the primary plane of the sash/leaf, in particular perpendicular to the primary plane of the sash/leaf.

3. The displacement arrangement according to claim 1, wherein the control part is rotatably mounted on the guide part, wherein the rotational axis is arranged parallel to the primary plane of the sash/leaf.

4. The displacement arrangement according to claim 1, wherein the displacement arrangement has a roller arrangement arranged or formed on the control part and/or a support arrangement for supporting on the fixed frame.

5. The displacement arrangement according to claim 1, wherein the control projection has a second rolling bearing for the low-friction guidance of the control projection in the first control slot.

6. The displacement arrangement according to claim 1, wherein the displacement arrangement has a supporting rolling bearing between the guide part and the control part.

7. The displacement arrangement according to claim 1, wherein the displacement arrangement has a second control projection and a second control slot for the actuation of the control part, wherein the second control projection is incorporated in portions in the second control slot and wherein the guide part has a second guide slot in which the second control projection is incorporated in portions.

8. The displacement arrangement according to claim 7, wherein the second control projection is formed equal to the control projection.

9. The window or door having the fixed frame, the sash/leaf and the displacement arrangement according to claim 1 to guide the sash/leaf relative to the fixed frame.

10. The window or door according to claim 9, wherein the sash/leaf is formed in a shape of a slide sash/leaf which can be set-out from the fixed frame and displaced parallel to the fixed frame.

* * * * *